US008646625B2

(12) United States Patent
Wang

(10) Patent No.: US 8,646,625 B2
(45) Date of Patent: Feb. 11, 2014

(54) COMBINATION HOOK RACK

(76) Inventor: Wen-Tsan Wang, Taipei (TW)

( * ) Notice: Subject to any disclaimer, the term of this patent is extended or adjusted under 35 U.S.C. 154(b) by 340 days.

(21) Appl. No.: 13/006,405

(22) Filed: Jan. 13, 2011

(65) Prior Publication Data

US 2012/0181244 A1 Jul. 19, 2012

(51) Int. Cl.
*A47F 5/08* (2006.01)

(52) U.S. Cl.
USPC ..... 211/106.01; 248/301

(58) Field of Classification Search
USPC ..... 211/60.1, 63, 66, 70.2, 70.5, 70.6, 70.7, 211/70.8, 85.3, 87.01, 94.01, 106.01, 113, 211/119.004, 119.006, 119.007, 123, 124; 248/214, 215, 220.31, 220.41, 301, 248/304, 307, 480, 690; 224/268, 560, 572; D8/367, 368, 371; D6/323
See application file for complete search history.

(56) References Cited

U.S. PATENT DOCUMENTS

| | | | | | |
|---|---|---|---|---|---|
| 643,818 | A * | 2/1900 | Headland | 211/113 |
| 674,868 | A * | 5/1901 | Lane | 211/41.11 |
| 891,538 | A * | 6/1908 | Greenman | 248/301 |
| 1,350,632 | A * | 8/1920 | Albrecht | 452/189 |
| 1,892,500 | A * | 12/1932 | Bleckley | 211/70.7 |
| 1,995,246 | A * | 3/1935 | Greims | 211/94.01 |
| 2,509,336 | A * | 5/1950 | Darby | 211/35 |
| 2,510,452 | A * | 6/1950 | Witt | 211/85.3 |
| 2,546,720 | A * | 3/1951 | Brothers | 211/85.3 |
| 2,614,702 | A * | 10/1952 | Riblet | 108/30 |
| 2,643,775 | A * | 6/1953 | Franklin | 211/85.3 |
| 4,714,166 | A * | 12/1987 | Hann et al. | 211/94.01 |
| D353,502 | S * | 12/1994 | Liu | D6/514 |
| D406,972 | S * | 3/1999 | McCoy | D6/513 |
| 5,967,344 | A * | 10/1999 | Liberati | 211/87.01 |
| 6,003,694 | A * | 12/1999 | Sharp | 211/85.3 |
| 6,105,839 | A * | 8/2000 | Bell | 224/275 |
| 6,394,287 | B2 * | 5/2002 | Cabrera | 211/70.2 |
| D468,624 | S * | 1/2003 | Goodman et al. | D8/371 |
| 6,530,489 | B1 * | 3/2003 | Van Horn et al. | 211/113 |
| 7,748,544 | B1 * | 7/2010 | Davitz | 211/70.6 |
| 7,789,248 | B1 * | 9/2010 | Salerno et al. | 211/85.7 |
| 7,789,249 | B1 * | 9/2010 | Merbeth | 211/87.01 |
| 7,798,463 | B2 * | 9/2010 | Morgenroth | 248/475.1 |
| 2007/0095768 | A1 * | 5/2007 | Huo | 211/113 |
| 2010/0084530 | A1 * | 4/2010 | Lai | 248/304 |

* cited by examiner

*Primary Examiner* — Joshua Rodden
(74) *Attorney, Agent, or Firm* — Leong C. Lei

(57) ABSTRACT

A combination hook rack includes a rack frame formed of two elongated frame plates and spacer blocks fixedly set in between the two elongated frame plates and kept apart from one another at a distance, hanging belts affixed to the rack frame and provided with a respective hook at the free end for hanging the rack frame on a high place, and hook assemblies affixed to the rack frame for hanging things, each hook assembly including multiple lower hooks that define at least one space therebetween and come into contact at their ends, so that the lower hooks of each hook assembly can be used as a whole to hold a heavy thing or can be separated into individual hooks to hold light things.

1 Claim, 8 Drawing Sheets

COMBINATION HOOK RACK

BACKGROUND OF THE INVENTION a) Field of the Invention

The present invention relates to a hook rack for hanging things and more particularly to a combination hook rack that can be used in a limited space area for hanging a big number of things.

b) Description of the Related Art

Clothes trees and hook racks may be used in houses for hanging clothes, hats, handbags, shopping bags and many other things. In order to fully utilize the limited house space, hanging hooks may be affixed to the back panel of the door of a room for hanging things.

People may adhere or affix hanging hooks individually to the back panel of a door at selected locations for hanging things. Several hanging hooks may be arranged together and affixed to the back panel of a door to form a hook rack. Some commercial hanging hooks provide one single hook portion for hanging things. Some other commercial hanging hooks provide multiple hook portions for hanging things. Further, a regular hook rack has a fixed number of hooks for hanging. The number of hooks of a regular hook rack is not adjustable to fit different application requirements.

SUMMARY OF THE INVENTION

The present invention has been accomplished under the circumstances in view. It is one object of the present invention to provide a combination hook rack, which is expandable for use in a limited space area for hanging a big number of things.

To achieve this and other objects of the present invention, a combination hook rack comprises a rack frame, and a plurality of hook assemblies. The rack frame comprises two elongated frame plates arranged in parallel, and a plurality of spacer blocks fixedly set in between the two elongated frame plates to define multiple slits therebetween. The hook assemblies are affixed to the rack frame for hanging things. Each hook assembly is formed of a plurality of flat bars, each flat bar having an upper section and a lower section. The upper sections of the flat bars are bonded together to form a bonded upper section. The lower sections of the flat bars are bent to form multiple lower hooks that define at least one space therebetween and come into contact at their ends. A plurality of mounting through holes are defined at the bonded upper section for being inserted with fasteners for allowing each hook assembly to be fixedly affixed to the rack frame. In use, the lower hooks of each hook assembly can be used as a whole to hold a heavy thing or can be separated into individual hooks to hold light things.

Further, movable hook members are detachably engaged in the slits between the elongated frame plates of the frame rack and supported on the front elongated frame plate of the rack frame for hanging things.

Further, hanging belts can be affixed to the rack frame for hanging the rack frame on a high place, for example, the top edge of a door in a house. Each hanging belt has one end thereof affixed to the rack frame and an opposite end thereof provided with a hook for hanging.

DETAILED DESCRIPTION OF THE PREFERRED EMBODIMENT

Figure 1:
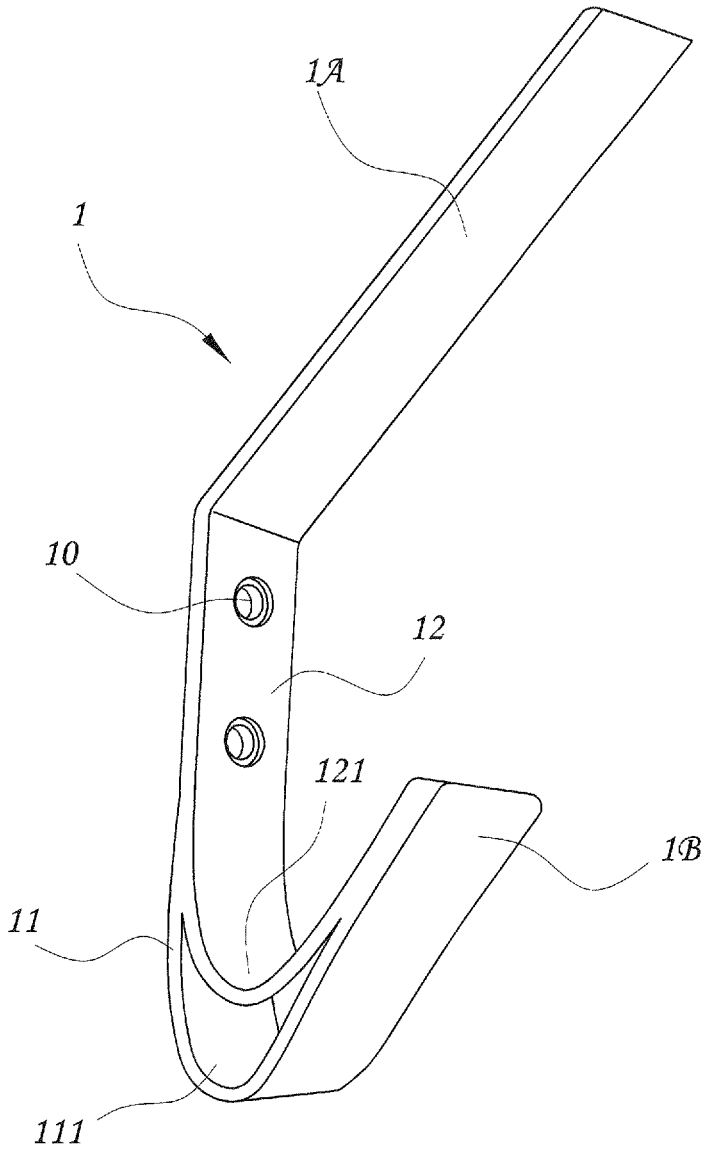
FIG. 1 is an elevational view of a hook assembly for combination hook rack in accordance with a first embodiment of the present invention.

Referring to FIG. 1, a hook assembly 1 for combination hook rack in accordance with a first embodiment of the present invention is formed of a first flat bar 11 and a second flat bar 12. Each flat bar has an upper section, a middle section, and a lower section. In this embodiment, the first flat bar 11 has a lower section 111, and the second flat bar 12 has a lower section 121. The upper section of each flat bar is bent at an angle with its corresponding middle section to incline upwardly. The upper sections of the flat bars 11, 12 are bonded together to form an upper hook 1A. The middle sections of the flat bars 11, 12 are bonded together to form a bonded middle section. The lower sections 111, 121 of the flat bars 11, 12 are bent to form two lower hooks 1B that define a space therebetween and come into contact at their ends. Further, the hook assembly 1 can be processed to provide mounting through holes 10 at suitable locations, for example, at the bonded middle section thereof at different elevations. The mounting through holes 10 can be inserted with fasteners to allow the hook assembly 1 to be fixedly affixed to a frame.

Figure 2:
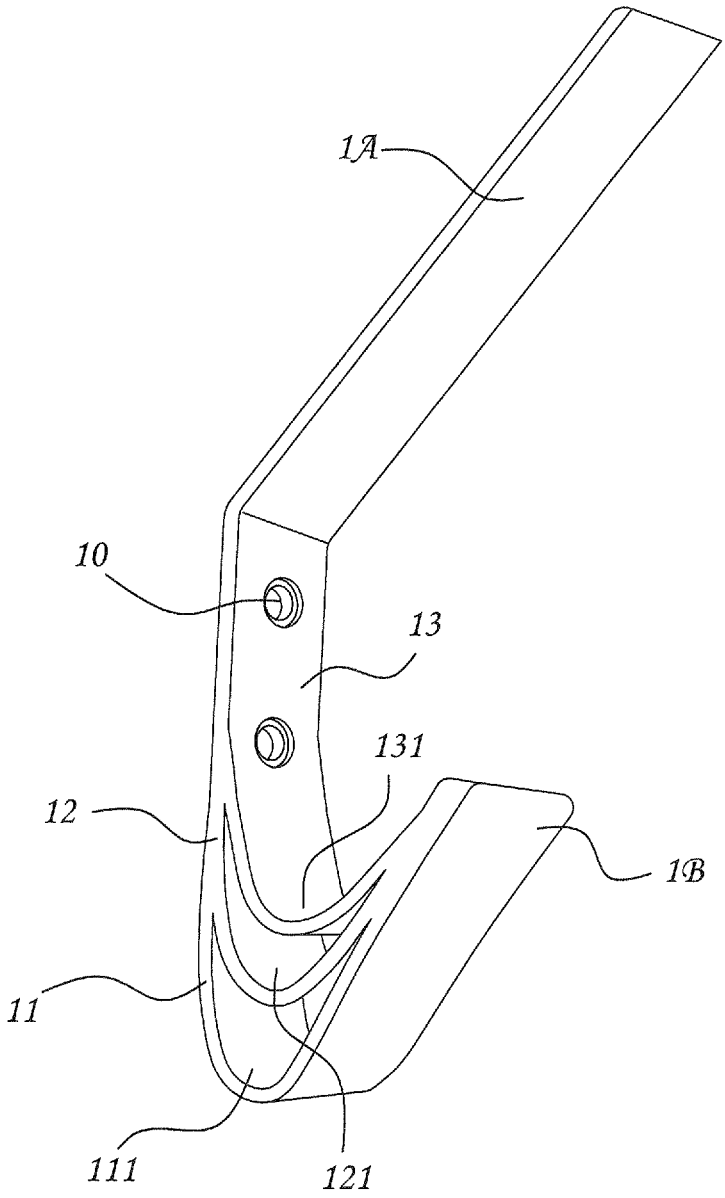
FIG. 2 is an elevational view of a hook assembly for combination hook rack in accordance with a second embodiment of the present invention.

FIG. 2 illustrates a hook assembly 1 for combination hook rack in accordance with a second embodiment of the present invention, which is formed of a first flat bar 11, a second flat bar 12 and a third flat bar 13. Each bar has an upper section, a middle section, and a lower section. In this embodiment, the first flat bar 11 has a lower section 111, the second flat bar 12 has a lower section 121, and the third flat bar 13 has a lower section 131. The upper section of each flat bar is bent at an angle with its corresponding middle section to incline upwardly. The upper sections of the flat bars 11, 12, 13 are bonded together to form an upper hook 1A. The middle sections of the flat bars 11, 12, 13 are bonded together to form a bonded middle section. The lower sections 111, 121, 131 of the flat bars 11, 12, 13 are bent to form three lower hooks 1B that define two spaces therebetween and come into contact at their ends. Further, the hook assembly 1 can be processed to provide mounting through holes 10 at suitable locations, for example, at the bonded middle section thereof at different elevations. The mounting through holes 10 can be inserted with fasteners to allow the hook assembly 1 to be fixedly affixed to a frame.

Figure 3:
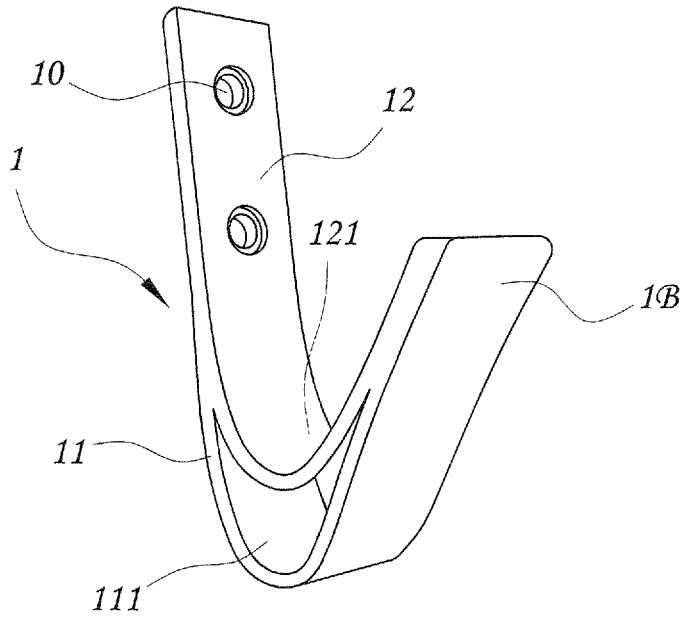
FIG. 3 is an elevational view of a hook assembly for combination hook rack in accordance with a third embodiment of the present invention.

FIG. 3 illustrates a hook assembly 1 for combination hook rack in accordance with a third embodiment of the present, which is formed of a first flat bar 11 and a second flat bar 12.

Each flat bar has an upper section and a lower section. In this embodiment, the first flat bar 11 has a lower section 111, and the second flat bar 12 has a lower section 121. The upper sections of the flat bars 11, 12 are bonded together to from a bonded upper section. The lower sections 111, 121 of the flat bars 11, 12 are bend to form two lower hooks 1B that define a space therebetween and come into contact at their ends. Further, the hook assembly 1 can be processed to provide mounting through holes 10 at the bonded upper section thereof for mounting. The mounting through holes 10 can be inserted with fasteners to allow the hook assembly 1 to be fixedly affixed to a frame.

Figure 4:
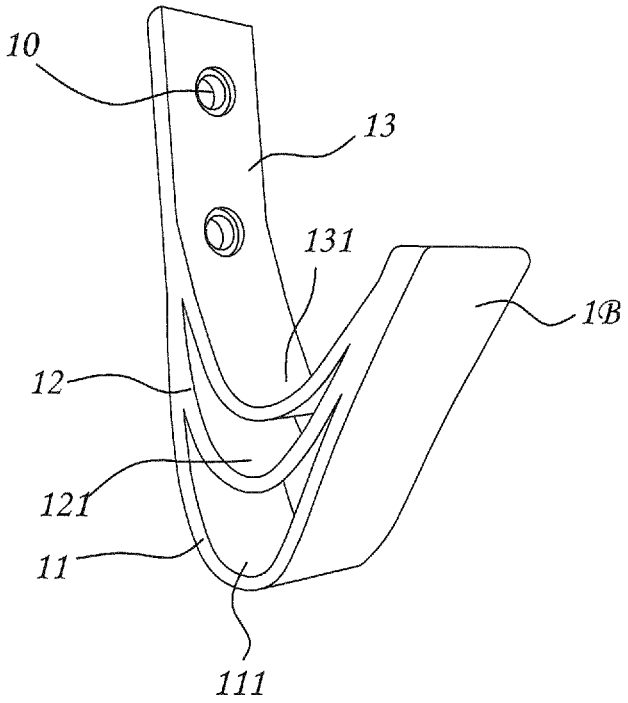
FIG. 4 is an elevational view of a hook assembly for combination hook rack in accordance with a four embodiment of the present invention.

FIG. 4 illustrates hook assembly 1 for combination hook rack in accordance with a fourth embodiment of the present invention is formed of a first flat bar 11, a second flat bar 12 and a third flat bar 13. Each flat bar has an upper section and a lower section. In this embodiment, the first flat bar 11 has a lower section 111, the second flat bar 12 has a lower section 121, and the third flat bar 13 has a lower section 131. The upper sections of the flat bars 11, 12, 13 are bonded together to form a bonded upper section. The lower sections 111, 121, 131 of the flat bars 11, 12, 13 are bonded to form three lower hooks 1B that define two spaces therebetween and come into contact at their ends. Further, the hook assembly 1 can be processed to provide mounting through holes 10 at the bonded upper section thereof for mounting. The mounting through holes 10 can be inserted with fasteners to allow the hook assembly 1 to be fixedly affixed to a frame.

Figure 5:
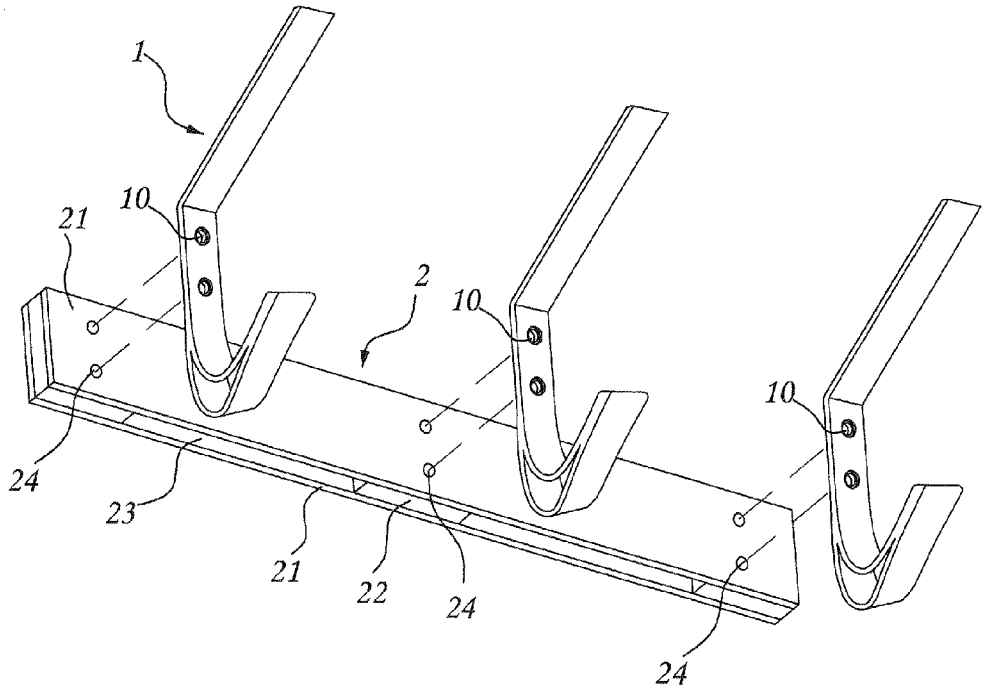
FIG. 5 is an exploded view of a combination hook rack in accordance with the present invention.

Referring to FIG. 5, a combination hook rack is shown comprising a rack frame 2 and a plurality of hook assemblies 1 prepared according to the first embodiment of the present invention and affixed to the rack frame 2. The rack frame 2, which can be mounted to a wall or a door, comprises two elongated frame plates 21 arranged in parallel, and a plurality of spacer blocks 22 fixedly set in between the two elongated frame plates 21 to define multiple slits 23 between the elongated frame plates 21. A plurality of mounting through holes 24 are defined at the frame rack 2 at locations corresponding to the mounting through holes 10 of the hook assemblies 1. Fasteners, for example, screws (not shown) are fastened to the mounting through holes 10 of the hook assemblies 1 and the mounting through holes 24 of the rack frame 2 to affix the hook assemblies 1 to the rack frame 2. In use, the lower hooks 1B can be used as a whole to hold a heavy thing or can be separated into individual hooks to hold light things. Additionally, the upper hook 1A can be used to hold various things.

Figure 6:
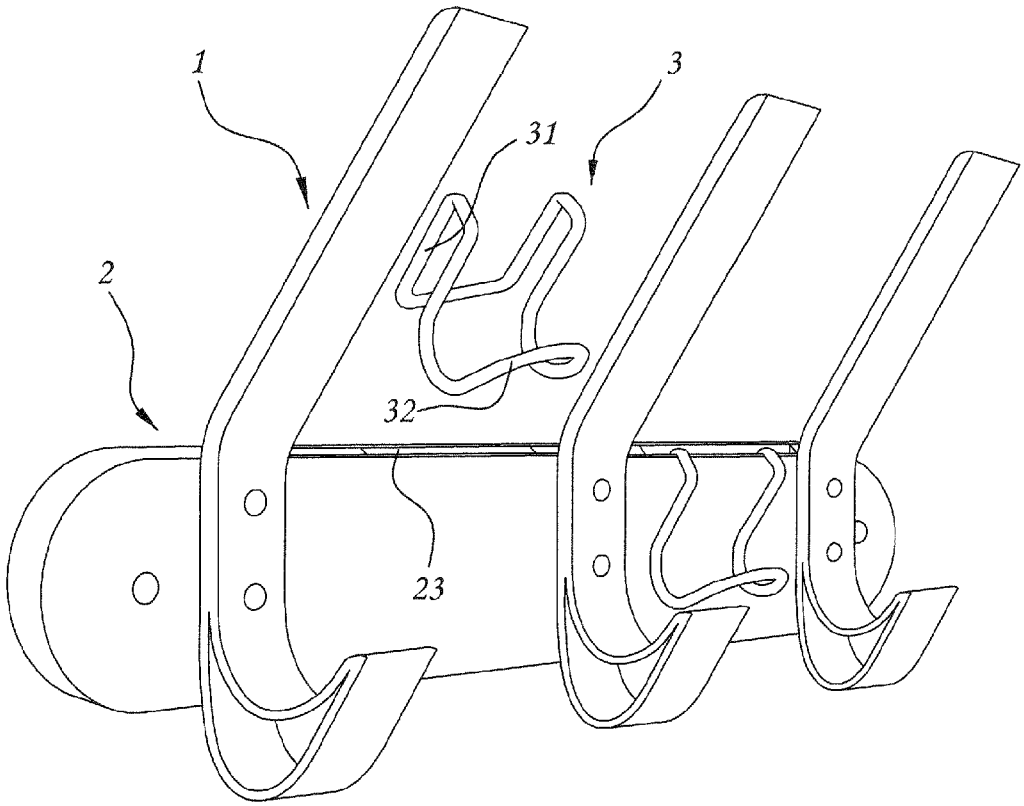
FIG. 6 illustrates a combination hook used with movable hook members and hook assemblies prepared according to the first embodiment of the present invention.
Figure 7:
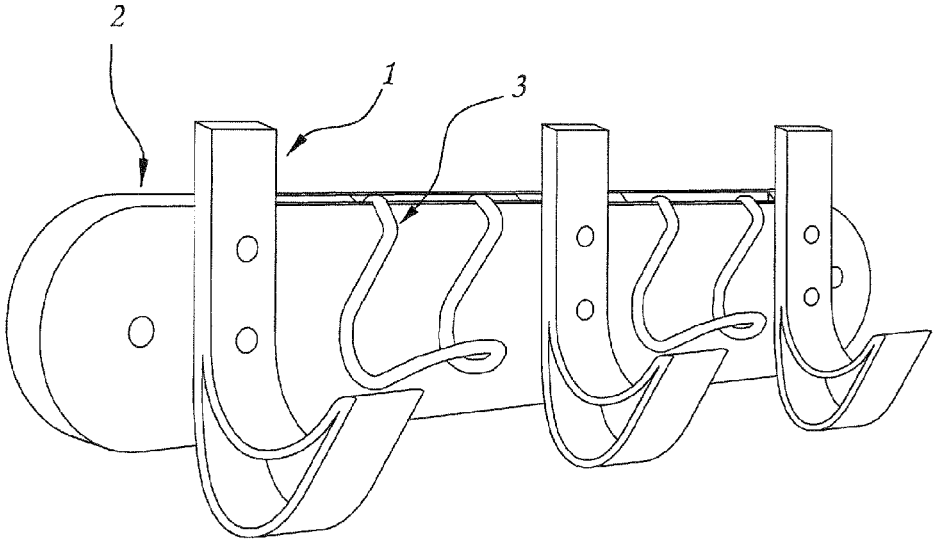
FIG. 7 illustrates a combination hook used with movable hook members and hook assemblies prepared according to the third embodiment of the present invention.

Referring to FIG. 6 and FIG. 7, movable hook members 3 can be detachably engaged in the slits 23 defined between the elongated frame plates 21 of the rack frame 2 and supported on the front elongated frame plate 21 of the rack frame 2 for hanging things. The movable hook members 3 are respectively made by bending a metal wire rod into shape, each having a first hook portion 31 for engaging in one of the slits 23 defined between the elongated frame plates 21 of the rack frame 2 and a second hook portion 32 being located at the front side of the front elongated frame plate 21 of the rack frame 2 for hanging things.

Figure 8:
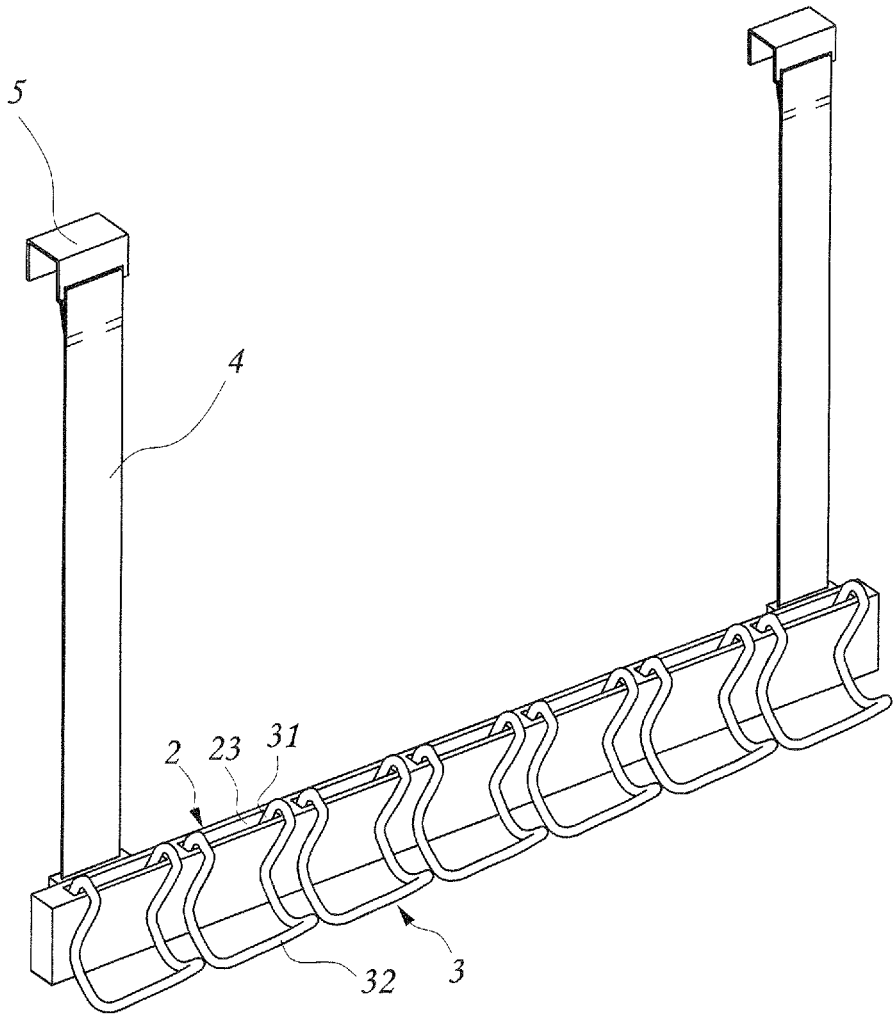
FIG. 8 illustrates a combination hook provided with hanging belts and used with movable hook members according to the present invention.

Referring to FIG. 8, a plurality of hanging belts 4 can be fastened to the rack frame 2 of the combination hook rack for hanging the combination hook rack on, for example, the top edge of a door in a house. Each hanging belt 4 has one end affixed to the rack frame 2, and the other end provided with a hook 5 for hanging.

Although particular embodiments of the invention have been described in detail for purposes of illustration, various modifications and enhancements may be made without departing from the spirit and scope of the invention. Accordingly, the invention is not to be limited except as by the appended claims.

I claim:

1. A combination hook rack, comprising:

a rack frame;

a plurality of hook assemblies affixed to said rack frame for hanging things, each said hook assembly being formed of a plurality of flat bars, each said flat bar having an upper section and a lower section, the upper sections of said flat bars being bonded together to form a bonded upper section, the lower sections of said flat bars being bent to form multiple lower hooks that define at least one space therebetween and come into contact at their ends, wherein a plurality of mounting through holes are defined at the bonded upper section for being inserted with fasteners for allowing each hook assembly to be fixedly affixed to said rack frame, whereby the lower hooks of each hook assembly can be used as a whole to hold a heavy thing or can be used individually to hold light things; and a plurality of movable hook members and wherein said rack frame is constructed of two parallel elongated frame plates including a front plate and a rear plate and being spaced by multiple spacer blocks to define multiple slits therebetween, said movable hook members being detachably supported on the front plate, wherein each movable hook member is constructed of metal wire rod and has a first hook portion for engaging in one of the slits and a second hook portion being located at a front side of the front plate for hanging things;

wherein said rack frame is hanged from a place via a plurality of hanging belts, each hanging belt having one end affixed to said rack frame and another end provided with a hook for hanging.

* * * * *